United States Patent [19]

VanBuskirk

[11] 4,124,204

[45] Nov. 7, 1978

[54] SORTING APPARATUS AND REPRODUCING MACHINE

[75] Inventor: Warren T. VanBuskirk, Rochester, N.Y.

[73] Assignee: Xerox Corporation, Stamford, Conn.

[21] Appl. No.: 784,294

[22] Filed: Apr. 4, 1977

[51] Int. Cl.[2] ..... B65H 29/58; B65H 29/16

[52] U.S. Cl. ..... 271/173; 49/386; 271/198; 271/273; 312/319; 312/328

[58] Field of Search ..... 271/173, 64, 200, 198, 271/273, 274, 275; 226/171; 198/813; 270/58; 312/319, 328; 49/386; 16/72, 73, 63, 65, 85

[56] References Cited

U.S. PATENT DOCUMENTS

| | | | |
|---|---|---|---|
| 1,683,622 | 9/1928 | Keller | 74/242.4 R |
| 2,555,880 | 6/1951 | Fruechtel | 198/856 |
| 2,557,749 | 6/1951 | Lundine | 49/386 |
| 2,828,178 | 3/1958 | Dahlgren | 312/319 |
| 3,460,824 | 8/1969 | Bahr et al. | 271/173 |
| 3,744,790 | 7/1973 | Hoffman | 271/173 |
| 3,766,726 | 10/1973 | Carroll | 226/171 X |
| 3,774,902 | 11/1973 | Schulze | 271/173 |
| 3,830,590 | 8/1974 | Harris et al. | 271/173 X |
| 3,831,830 | 8/1974 | Venot | 226/171 |
| 3,848,868 | 11/1974 | Stemmle | 271/173 |
| 3,879,032 | 4/1975 | Shirahase | 271/64 |
| 3,907,279 | 9/1975 | Ervin | 271/173 |
| 3,973,769 | 8/1976 | Cross et al. | 271/173 |
| 3,977,667 | 8/1976 | Cross et al. | 271/173 X |
| 3,988,018 | 10/1976 | Tusso et al. | 271/173 |
| 3,990,695 | 11/1976 | Cross et al. | 271/64 |

*Primary Examiner*—Bruce H. Stoner, Jr.

[57] ABSTRACT

An improved sorting apparatus and reproducing machine are provided with a plurality of sheet receiving bins. A first frame supports the bins. A sheet transport is arranged in a second frame. The frames are supported for relative movement between a first closed position wherein the sheet transport is operatively associated with the bins and a second open position wherein access is provided to the transport and bins for sheet clearance. The sheet transport includes at least one belt which is operatively maintained under a desired tension. A device is provided for reducing the belt tension in response to the relative movement of the frames between their respective closed and open positions. In accordance with another feature a counterbalance is provided for counterbalancing the frame supporting the transport as it moves away from the frame supporting the bins. The counterbalance comprises at least one cantilever spring mounted to the bin frame and a roller type device mounted to the transport frame which engages the cantilever spring.

15 Claims, 15 Drawing Figures

SORTING APPARATUS AND REPRODUCING MACHINE

CROSS REFERENCE TO RELATED APPLICATIONS

U.S. application Ser. No. 784,500, filed Apr. 4, 1977, to VanBuskirk, et al., for a "sorting apparatus and reproducing machine"; and U.S. application Ser. No. 783,358, filed Mar. 31, 1977, to Tates, et al., for a "sorting apparatus and reproducing machine".

BACKGROUND OF THE INVENTION

This invention relates to a sorting apparatus for collating the output of a reproducing machine into one or more sets. A reproducing machine incorporating the sorting apparatus of this invention also forms a part of the invention.

PRIOR ART STATEMENT

Numerous sorting apparatus are known in the prior art for collating the output of reproducing machines into a desired number of sets.

U.S. Pat. Nos. 3,774,902, to Schulze, 3,848,868 to Stemmle, 3,879,032 to Shirahase, and 3,973,769, 3,977,667, and 3,990,695, all to Cross, et al. deal with sorting apparatuses wherein a vertical array of generally parallel horizontally extending inclined sorter trays are arranged to collate the output of a reproducing machine into a plurality of sets. It is a feature of each of these sorting apparatuses that the bin entrance openings of the respective bins are selectively increased in size by pivoting the upper tray defining the respective bin as a sheet is fed into it. Each of the sorting apparatuses disclosed includes a generally horizontally extending sheet transport and a vertical sheet transport. The Cross, et al. patents, particularly U.S. Pat. No. 3,973,769, show the use of a vertical transport which is arranged to pivot away from the main sorter frame which supports the respective bin defining trays.

It is known to provide sorting apparatuses arranged with trays in a vertical array wherein deflection gates are associated with each of the respective bins in order to strip sheets from the vertical transport and deflect them into the bins. Such an approach is shown, for example, in U.S. Pat. Nos. 3,460,824, to Bahr, et al., and 3,988,018 to Tusso, et al. In these patents, the individual deflection gates associated with the respective bins are actuated by a cam drive mechanism wherein the cams are selectively advanced to sequentially actuate the respective deflection gates for deflecting the sheets into the bins.

It is also known as illustrated in U.S. Pat. Nos. 3,774,790 to Hoffman, and 3,830,590 to Harris, et al., to utilize solenoid actuation instead of cams for actuating the deflection gates associated with the bins of a sorter.

U.S. Pat. No. 3,907,279, to Ervin shows a sorter wherein the bin defining trays are movable or removable to enlarge selected bins to embrace two or more input stations so that different numbers of copies can be delivered to different bins.

In U.S. Pat. No. 1,683,622 to Keller, an improved motor mounting and housing is described wherein a drive motor is mounted within a frame of a motor driven machine such that removal of a closure plate from the machine frame will simultaneously withdraw the motor for inspection. The motor is movably associated with the closure plate so that at least a portion of the weight of the motor is utilized to properly tension the drive belt of the machine. The drive belt may be removed and the motor quickly withdrawn for inspection by swinging the closure plate forward to a horizontal position.

In U.S. Pat. No. 2,555,880 to Fruechtel a conveyor is provided with a non-slipping drive. A motor is arranged to actuate the drive and is supported upon a movable base mounted to swing away when the drive resistance to the non-slipping drive exceeds a predetermined value. Responsive to such movement of the base, the non-slipping drive is de-energized.

SUMMARY OF THE INVENTION

In accordance with this invention an improved sorting apparatus and a reproducing machine employing the apparatus are provided. The sorting apparatus is arranged to collate the sheet output of the reproducing machine.

In accordance with one feature, the sorting apparatus comprises a plurality of sheet receiving bins. A first frame is arranged to support the sheet receiving bins. Means are provided for transporting the sheets to the bins. The sheet transport means includes at least one belt under a desired operational tension. A second frame is provided for supporting the sheet transport means. The first and second frames are supported for relative movement between a first closed position wherein the transport means is operatively associated with the bins and a second open position wherein access is provided to the transport means and the bins for sheet clearance therefrom. In accordance with the present invention, means are provided in the sorting apparatus for reducing the belt tension in response to the relative movement of the frames from the first closed position to the second open position thereby facilitating the sheet clearance.

In accordance with yet another feature of this invention the frame supporting the transport means is pivotally supported in the frame supporting the bins and is arranged for movement toward and away from the frame supporting the bins. Counterbalance means are provided for counterbalancing the second frame as it moves between its closed and open position. The counterbalance means preferably comprises at least one cantilever spring mounted to the first frame and a means associated with the second frame for engaging the cantilever spring.

Accordingly, it is an object of the present invention to provide an improved sorting apparatus for collating the output of a reproducing machine.

It is a further object of this invention to provide a sorting apparatus as above utilized with a reproducing machine.

These and other objects will become more apparent from the following description and drawings.

DETAILED DESCRIPTION OF THE PREFERRED EMBODIMENTS

Figure 1:
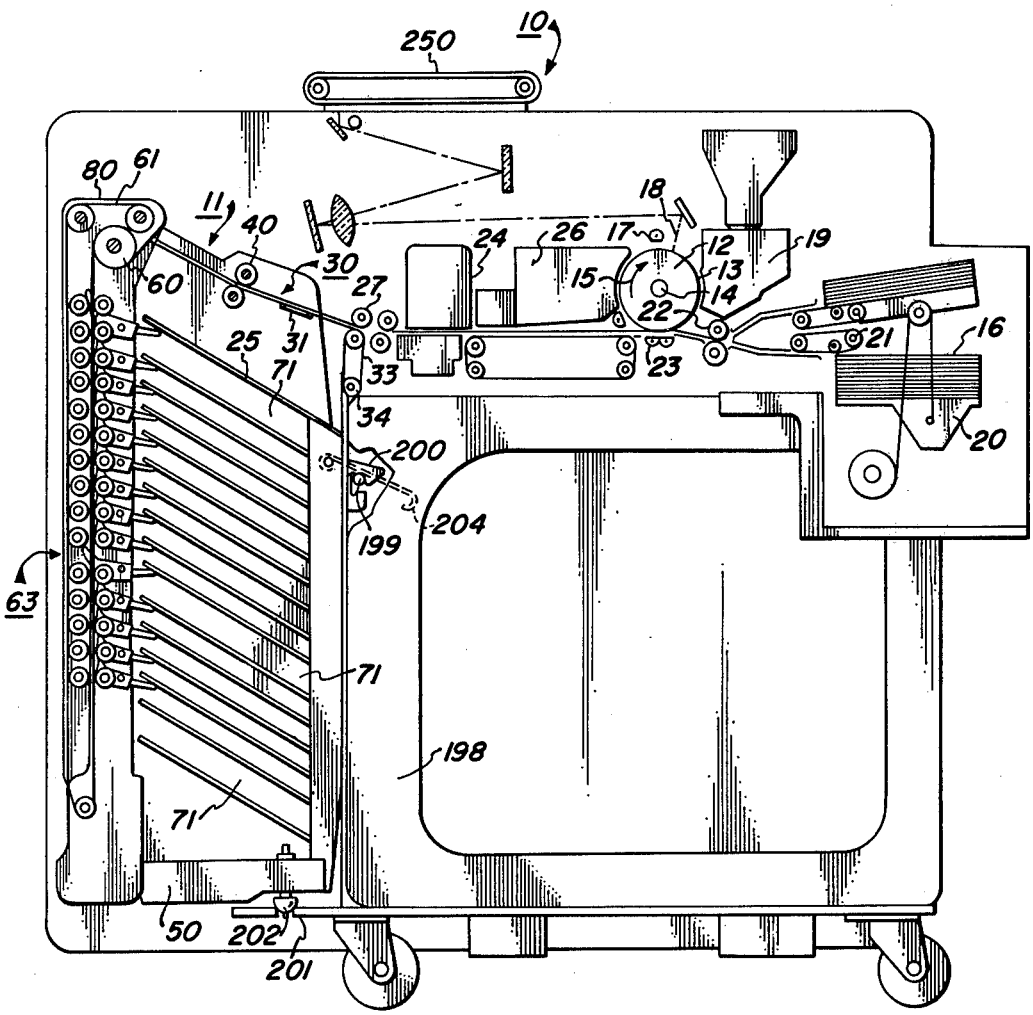
FIG. 1 is a schematic representation of a reproducing apparatus and sorting apparatus of this invention.

Referring now to FIG. 1 there is shown by way of example an automatic xerographic reproducing machine 10 which includes the sorting apparatus 11 of the present invention. The reproducing machine 10 depicted in FIG. 1 illustrates the various components utilized therein for producing copies from an original. Although the apparatuses 11 of the present invention are particularly well adapted for use in an automatic xerographic reproducing machine 10, it should become evident from the following description that they are equally well suited for use in a wide variety of processing systems including other electrostatographic systems and they are not necessarily limited in their application to the particular embodiment or embodiments shown herein.

The reproducing machine 10 illustrated in FIG. 1 employs an image recording drum-like member 12, the outer periphery of which is coated with a suitable photoconductive material 13. One type of suitable photoconductive material is disclosed in U.S. Pat. No. 2,970,906, issued to Bixby in 1961. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophotography* by Schaffert, and *Xerography and Related Processes* by Dessauer and Clark, both published in 1965 by the Focal Press.

Initially, the drum 12 moves the photoconductive surface 13 through a charging station 17. In the charging station 17, an electrostatic charge is placed uniformly over the photoconductive surface 13 preparatory to imaging. The charging may be provided by a corona generating device of the type described in U.S. Pat. No. 2,836,726, issued to Vyverberg in 1958.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,832,057, issued to Shogren in 1974. After exposure drum 12 rotates the electrostatic latent image recorded on the photoconductive surface 13 to development station 19 wherein a conventional developer mix is applied to the photoconductive surface 13 of the drum 12 rendering the latent image visible. A suitable development station is disclosed in U.S. Pat. No. 3,707,947, issued to Reichart in 1973. That patent describes a magnetic brush development system utilizing a magnetizable developer mix having coarse ferromagnetic carrier granules and toner colorant particles. The developer mix is brought through a directional flux field to form a brush thereof. The electrostatic latent image recorded on the photoconductive surface 13 is developed by bringing the brush of developer mix into contact therewith.

Sheets 16 of final support material are supported in a stack arrangement on an elevating stack support tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. The final support material may be paper, plastic, etc., as desired.

After the toner image has been transferred to the sheet of final support material 16 the sheet with the image thereon is advanced to a suitable fuser 24 which coalesces the transferred powder image thereto. One type of suitable fuser is described in U.S. Pat. No. 2,701,765, issued to Codichini, et al. in 1955. After the fusing process the sheet 16 is advanced to a suitable output device such as tray 25.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as, for example, the use of a blade as set forth in U.S. Pat. No. 3,740,789, issued to Ticknor in 1973.

It is believed that the foregoing description is sufficient for purposes of the present application to illustrate the general operation of an automatic xerographic copier 10 which can embody the apparatus 11 in accordance with the present invention.

In accordance with this invention it is desired to provide a sorting apparatus for a copier which is compact, low in cost, high in reliability, and which has a low power consumption. It is also desired to provide a modular construction so that the number of bins of the sorting device can be readily altered depending on the needs of the customer.

A variety of prior art approaches are described in the background of this invention which are adapted to accomplish various of the respective goals set forth. However, they are all deficient in various ways. For example, the use of vacuum transports while providing high reliability for sheet handling also is very costly from the standpoint of power consumption.

Referring to FIGS. 1 - 7, the sorter 11 is arranged adjacent the output of the xerographic processor. As a sheet 16 exists from the fuser 24, it is carried by the processor output rolls 27 along the horizontal sorter transport 30. A deflection gate or pivoting chute 31 is arranged to selectively deflect the sheet 16 from the horizontal sorter transport 30 into the output tray 25 or to allow its continued advancement along the horizontal transport. When the chute 31 is in its up position as shown in solid lines in FIG. 2, the sheet 16 exists from the output rolls 27 and falls into the output tray 25 which is inclined downwardly toward the processor 10. O-rings 33 are arranged about the lower output roll 27 and an adjacent idler roll 34 positioned below the lower output roll. The function of the O-rings 33 is to aid in stacking the sheets in the output tray 25 by driving the trail edge of the sheets downwardly into the tray. When sorting is desired, the deflection chute 31 is moved to its down position, as shown in phantom in FIG. 2, so that the sheets are fed along the horizontal transport 30 of the sorter 11. The deflection chute is actuated by means of a solenoid 35.

Driven pinch rollers 40 are arranged at an intermediate position along the horizontal sorter transport 30. These rollers are driven to advance the sheet at about the speed of the output rolls 27. The lower rollers 41 are pinned to driven shaft 42. The upper rollers 43 idle on shaft 44. A lever actuated jam detection switch 45 is provided following the rollers 40 for detecting jams, in the horizontal sorter transport.

Figure 3:
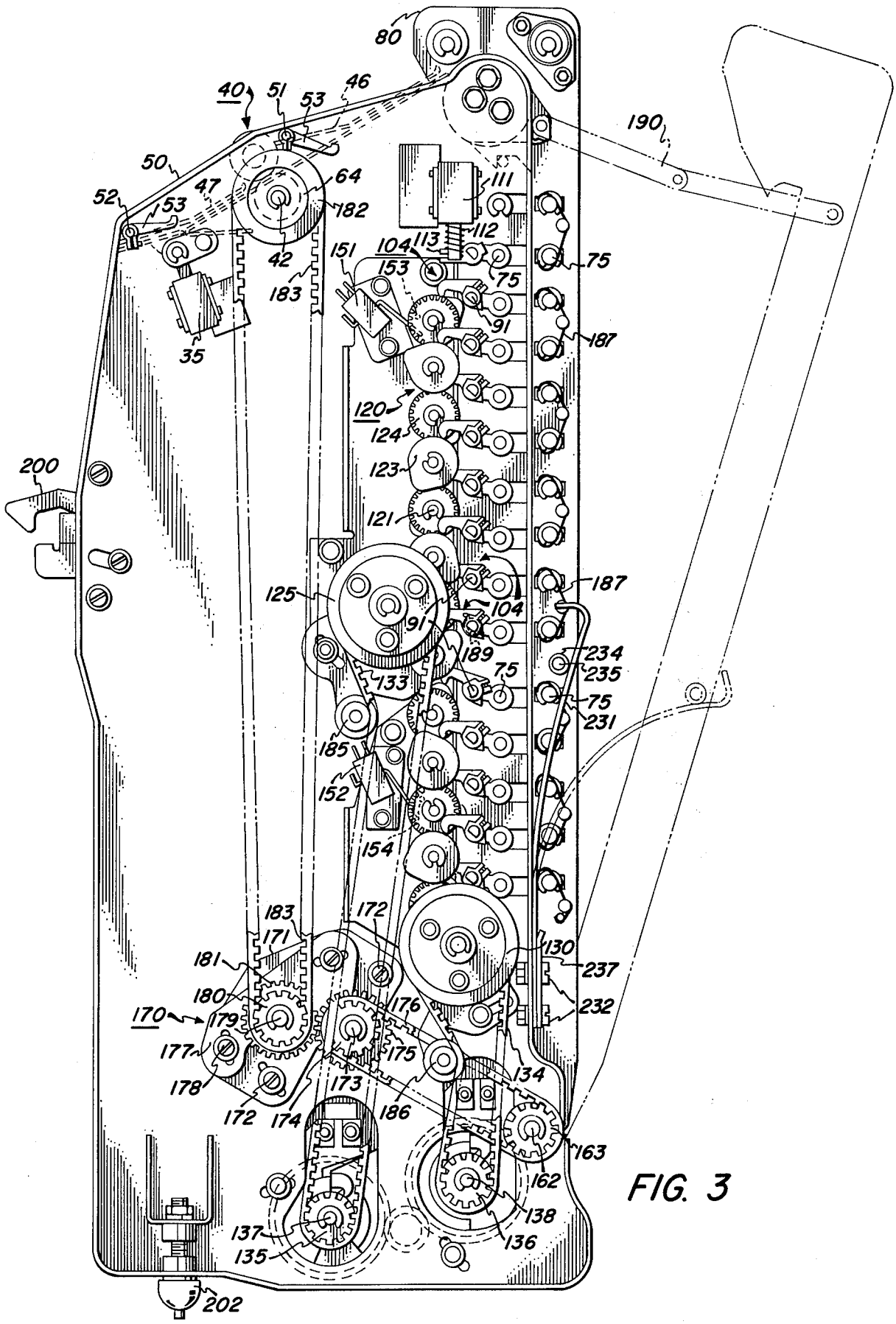
FIG. 3 is a rear view of the sorting apparatus.
Figure 4:
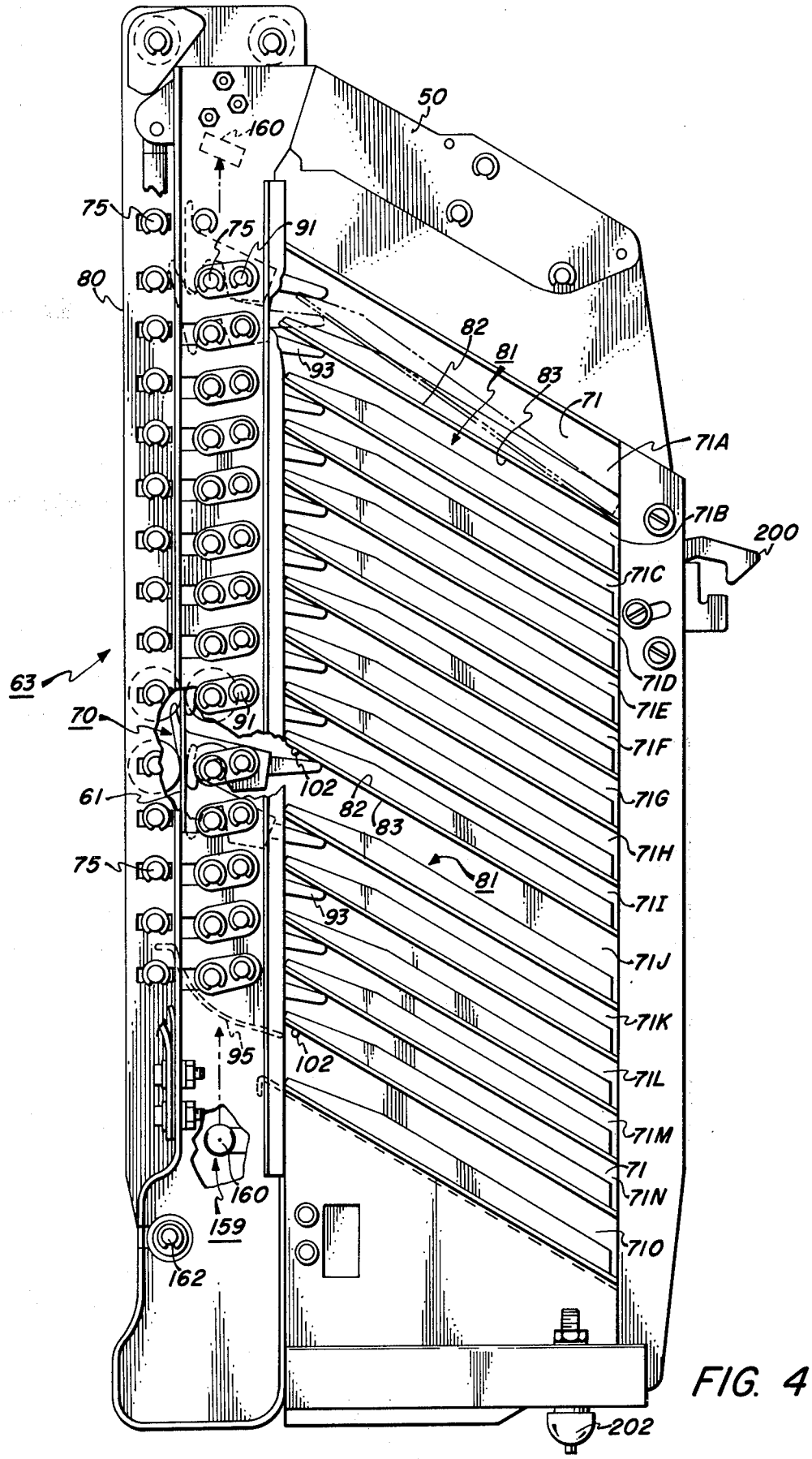
FIG. 4 is a front view of the sorting apparatus.

The upper sheet guides 46 and 47 comprise wire forms which are pivotally supported in the main sorter frame 50 about shafts 51 and 52 as shown in FIG. 3. Levers 53 are supported at the outer ends of the shafts 51 and 52 limit the pivotal motion of the guides 46 and 47 for jam clearance thereby preventing them from being left open during operation.

As a sheet 16 proceeds further along the horizontal transport 30, it is fed into the nip formed by turn roll 60 and drive belts 61. Upon exiting the nip the sheet 16 is guided by pivoting baffle 62 onto the vertical transport 63 of the sorter 11. The drive belts 61 are driven at high speed as compared to the horizontal transport rolls 40 so that upon the copy sheet being gripped in the nip between the turn roll 60 and the drive belts 61, it is pulled at a high speed from the nip of the horizontal transport rolls 40. In order to accomplish this, the driven lower rolls 41 are driven through an overrunning clutch 64 such that the rollers 41 can be overridden by the drive imparted to the sheet 16 by the vertical transport drive belts 61.

The vertical transport 63 is composed of a plurality of pinch roll sets 70. One set of pinch rolls being arranged adjacent each of the bins 71 of the sorter 11. A plurality of spaced apart drive belts 61 are arranged across the width of the sorter from front to back. They are carried about idler pulleys 72 and 73 so that inner-run 74 of the belts 61 wrap around the turn roll 60 to provide driving engagement with a sheet nipped therebetween. The inner-run 74 of the belts 61 runs through the nips of each of the pinch roll sets 70. The pinch rolls comprising the sets 70 are arranged to idle on their respective shafts 75. A drive pulley 76 is provided at the lower end of the vertical transport 63 for providing a drive input to the belts 61. The drive belts 61 provide the driving engagement with the sheet 16 as it is carried along the vertical transport 63. The inner-pinch rolls 77 are supported in the main sorter frame 50. The outer pinch rolls 78 are supported in a frame assembly or door 80 which is arranged to pivot away from the main sorter frame 50 in order to allow access to the vertical transport 63 sheet path for jam clearance by the operator.

The vertical sorter bin array is composed of a plurality of sorting trays 81 arranged in a parallel fashion, one above the other, to provide a vertical row of bins. Each bin 71 is defined by the sheet receiving tray 81. The first bin 71A has a desired operating width for handling the desired number of copy sheets to be collected in it. The last bin 71O of the sorter 11 has a comparable width. The width of a bin 71 is defined from the sheet supporting surface 82 of the tray 81 to the bottom surface 83 of the next adjacent tray. The intermediate bins 71B-I and K-N have a width which is less than the width of the first and last bins.

The sorting system 11 shown comprises 15 bins, however, as will be described later by reference to FIG. 15, the sorter has a modular construction which allows the total number of bins to be cut down to 10 bins, if desired, for low volume applications. This 10/15 bin modularity is accomplished by utilizing a 10th bin 71J which has the same width as the first and last bins 71A and 71O. For the 10 bin version of the sorter, the 10th bin 71J becomes the final bin.

The use of intermediate bins 71B-I and K-N which are closely spaced together provides a high degree of compactness.

For purposes of further explanation, the wider bins 71A, J and O will be described hereafter as full width bins and the narrower bins 71B-I and K-N will be described hereafter as compact bins. Each of the bins 71 is adapted to hold approximately the same number of sheets.

Figure 6:
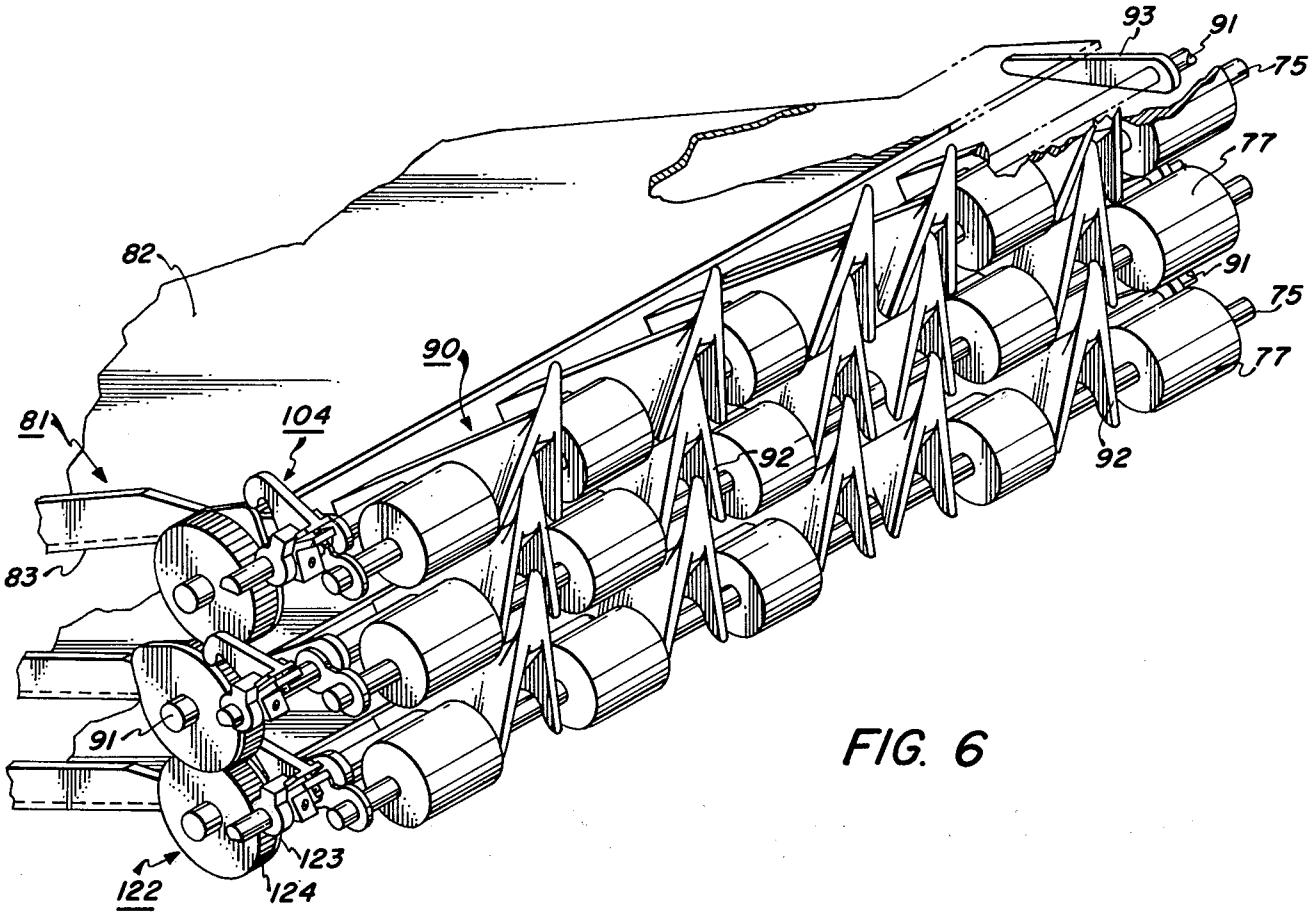
FIG. 6 is a partial perspective view of the inner-vertical transport and sheet deflection system of the sorting apparatus.

Associated with each of the bins 71, except the last bin 71O are a series of deflection gates 90 each supported upon a shaft 91 journaled in the sorter frame 50. A plurality of deflection fingers 92 are supported in a spaced apart relationship along each shaft 91 to define the respective gates 90. The deflection fingers 92 are arranged to project between the respective pinch rolls 77 which are also spaced apart along their respective shafts 75, as shown in FIG. 6. A stationary deflection chute 95 is used to guide a sheet 16 into the last bin 71O.

The compact bins 71B-I, and K-N are articulated such that their bin entrances can be selectively widened as a sheet is fed into them. This is accomplished by providing levers 93 secured at the ends of the deflection gate shafts 91, which operate against the bottom surface 83 of the tray 81 defining the top of the respective bin 71 with which the shaft 91 is associated. The levers 93 selectively operate upon the trays 81 outside the sheet path to cam them upwardly in order to widen the bin entrance opening as a sheet is fed into the bin.

Each of the trays 81 of the sorter 11 except for the top tray 25 which acts as the non-sorting output tray for the reproducing machine 10 and the bottom tray which rests on the sorter frame 50 are supported in a pivotal fashion within the sorter frame 50. Tabs 100 are provided at one end of the trays 81. The tabs 100 are positioned through slots in the sorter frame 50 to pivotally support the trays therein. Removable retaining pins 101 are placed through holes in the tray tabs 100 in order to retain the trays within the frame 50. The articulated trays 81 are arranged so that their other end is supported by the camming levers 93. The non-articulated trays 81, namely, the top trays associated with each of the full width bins 71 J and O are arranged so that their free ends rest against pins 102 supported in the sorter frame 50 as in FIG. 4.

While camming levers 93 are present on the deflection finger shafts 91 associated with the full width bins 71A, J, and O, they are not required, since the arc through which they sweep does not result in their engagement with the bottom of the tray 81 above the bin with which they are associated. They are included in the apparatus only because the deflection gate assembly 90 which includes the levers 93 is easier to fabricate as a common unit for each of the bins 71.

Each of the deflection gate shafts 91 is extended through the rear of the sorter frame 50 and includes at its extended end an adjustable follower element 104.

Figure 2:
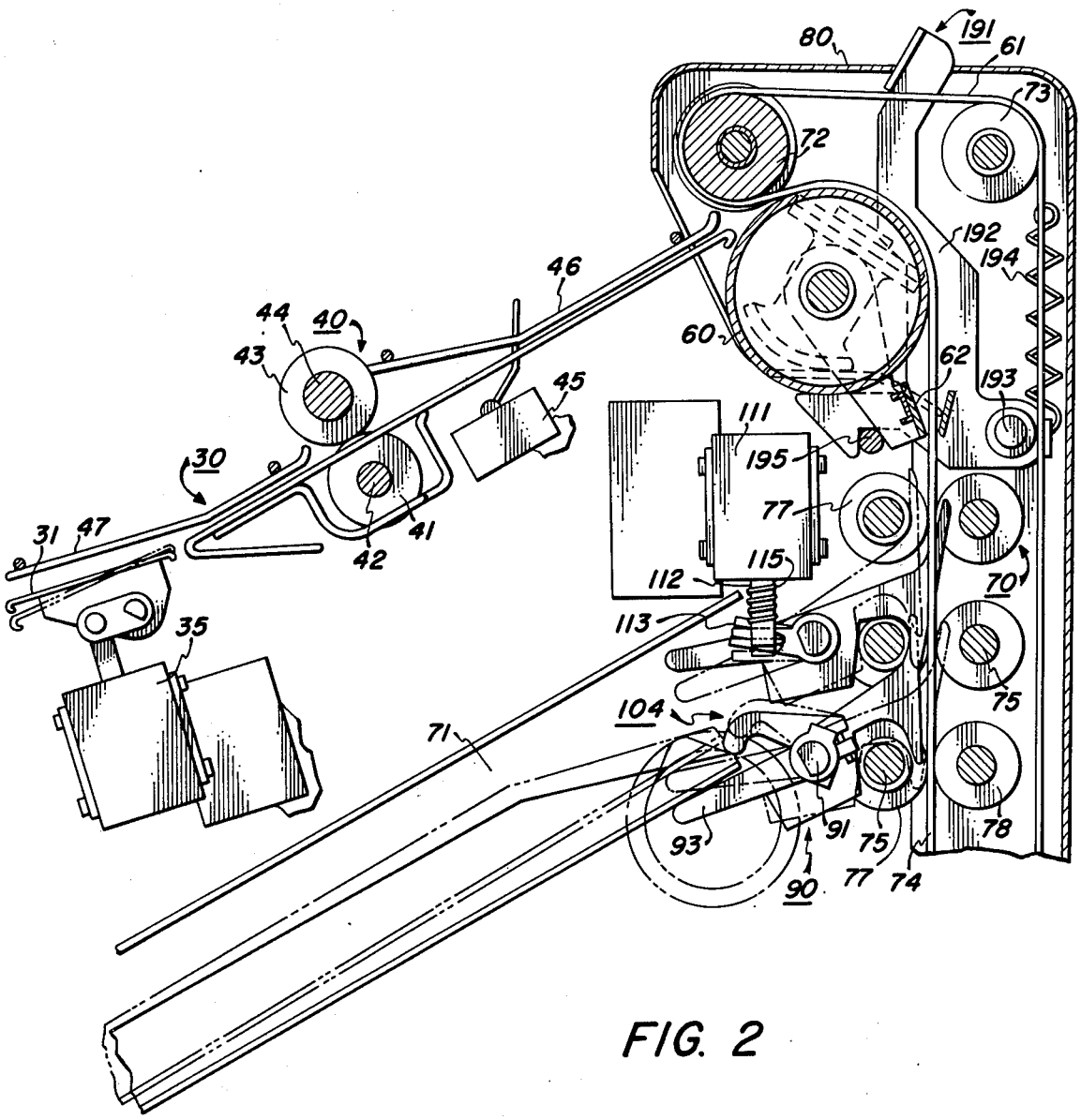
FIG. 2 is a partial section view of the sorting apparatus.
Figure 8:
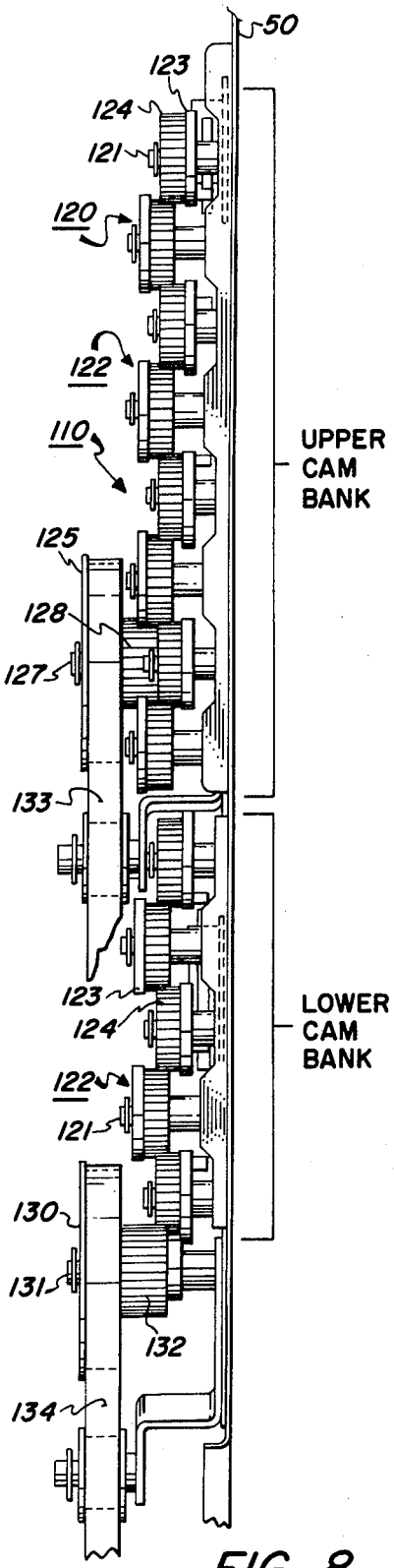
FIG. 8 is a partial side view of the bin and sheet deflector bin actuation system of the sorter.

The bin indexing drives 110 for the sorter 11 are best shown by reference to FIGS. 2, 3, and 8. The deflection gate 90 for the first bin 71A is arranged to be actuated by means of a solenoid 111. The armature 112 of the solenoid 111 is connected to the outboard end of the deflection gate shaft 91 by means of a fork-shaped coupling element 113. The shaft 91 of the first deflection gate is the only shaft which does not include a follower element 104. Compression spring 115 urges the first gate 90 closed when the solenoid 111 is not actuated.

The solenoid 111 is connected to the sorter control system (not shown) and is actuated in sequence for a time period sufficient to deflect a sheet 16 from the vertical transport 63 into the first bin 71A. The use of a solenoid actuated deflection gate 90 for the first bin 71A allows the sorter 11 to be recycled for receiving the first sheet of the next page being copied without reference to the position of the cam drive system 120 which sequences the deflection gates 90 of the remaining bins 71.

Each of the remaining deflection gates 90 is controlled by means of a modular cam drive system 120 supported in the rear side frame 50 of the sorter 11. A plurality of stub shafts 121 are provided for supporting cam units 122 for actuating each deflection gate 90 in sequence by operating on its respective follower element 104. Each cam unit 122 comprises a cam portion 123 and a gear portion 124. The cam elements are alternately arranged such that the cam portion 123 of one cam unit 122 is situated on one side of the respective gear portion 124 of that element while the cam portion 123 of the next adjacent unit 122 are situated on the opposite side of their respective gear portions 124. The high points of the cam portions 123 are arranged to sequentially actuate the deflection gates 90 for the bins 71 by engagement with the follower elements 104. The gear portions 124 of the respective cam units 122 for the bins 71B through 71I are inter-meshed. Similarly, the gear portions 124 of the cam units 122 for bins 71J through 71N are also inter-meshed. There is no connection between the gears 124 associated with cam units 122 for bins 71I and 71J. This allows the bin array to be modular so that, if desired, the bottom 5 bins can be removed at a substantial cost savings. The 10 bin modification will be described later by reference to FIG. 15.

An input drive pulley 125 is rotatably supported about shaft 127 and is connected to the upper cam units 122 through a coaxially gear portion 128 which meshes with the gear portion 124 of the cam unit for the 8th bin 71H. A second input drive pulley 130 is rotatably supported about shaft 131 and is connected to the lower cam units 122 through a coaxial gear portion 132 which meshes with the gear portion 124 of the cam unit for the 14th bin 71N. The input drive pulleys 125 and 130 are driven by respective timing belts 133 and 134 connected about respective first and second drive output pulleys 135 and 136 mounted to output shafts 137 and 138. The shafts 137 and 138 are suitably journaled and mounted to the sorter frame 50. Spur gears 141 and 142 are mounted to the shafts 137 and 138 via the input side wrap spring clutches 139 and 140, as shown by reference to FIG. 9, and are arranged to mesh with motor drive gear 143.

The wrap spring clutches 139 and 140 include respective detent collars 144 and 145 including three saw tooth-like detents arranged 120° apart. Solenoids S1 and S2 actuate pawls 147 and 148 to selectively disengage them from the detent collars 144 and 145 to increment the deflection gate drive.

During sorter operation the motor 150 is continuously driven as are the respective drive gears 141, 142, and 143. Intermittent motion is applied to the output drive pulleys 135 and 136 by selective operation of the solenoid actuated pawls 147 and 148. Each time a solenoid S1 and S2 is actuated, it momentarily lifts its pawl 147 or 148 and allows 120° of rotation of its respective output timing belt pulley 135 or 136. This 120° of rotation is translated by means of a 3:1 timing belt pulley ratio into a 40° rotation of the cam units 122. Due to the meshed gear arrangement of the cam bank, alternating adjacent cam units 122 rotate in the opposite direction. However, for each actuation of a solenoid S1 or S2 the cam units associated therewith rotate 40°. Therefore, for the upper cam bank which includes eight cam units 122, a series of nine solenoid S1 actuations returns the cam bank to its home position, namely, provides a full 360° of rotation of the cam units 122.

The home position of each cam bank is set by means of a home switch 151 or 152 which senses a pin 153 or 154 associated with the cam unit 122 of the upper cam bank for bin 71B or with the cam unit 122 of the lower cam bank for bin 71L.

In operation when the cam banks are in their home positions and sorting is selected, solenoid 111 actuates the deflection gate 90 for the first bin 71A. A sheet sensor 159 comprising light 160 and photodetector 161 are arranged to detect a sheet 16 entering any of the bins. After the sensor 159 detects that a given sheet has entered bin 71A, the upper cam bank is advanced 40° by actuation of solenoid S1 to cause the deflection gate 90 associated with the second bin 71B to enter the sheet path. As the upper cam bank indexes from its home position to the second bin 71B operative position the deflection gate shaft 91 associated with the second bin is rotated by operation of the first cam element 122 against the follower element 104 supported by the shaft. This causes the deflection gate 90 for the second bin 71B to move into the sheet feed path to deflect the next fed sheet into the second bin. As soon as the second sheet is sensed to have entered the second bin 71B, the upper cam bank is again indexed so that the next sheet will enter the next bin in line, etc., until sheets are received in the first nine bins 71A – 71I.

The lower cam bank home position is selected so that the deflection gate 90 for the 10th bin 71J, which is controlled by the first cam unit 122 of the lower cam bank is normally in its operative position to deflect a sheet from the vertical transport 63. Therefore, to feed the 10th sheet into the 10th bin 71J, the upper cam bank is indexed to its home position wherein none of the gates 90 associated therewith are operative. Solenoid 111 is not actuated so that the deflection gate 90 associated with bin 71A is inoperative. Upon sensing the 10th sheet entering bin 71J the lower cam bank is advanced 40° to open the 11th bin 71K deflection gate 90 to deflect the 11th sheet thereinto. This sequence is then repeated until the 15th bin 71O receives its sheet.

Since the upper cam bank has proceeded through a full cycle, it has been returned to its home position. The lower cam bank is also incremented in 40° intervals in order to provide commonality for the components of both cam banks. Therefore, upon completion of the 14th sheet entering the 14th bin 71N the lower cam bank is not in its home position. The lower cam bank is then recycled by continuous actuation of the second solenoid S2 until switch 152 senses the home position pin 154 of the lower cam bank.

The operation which has been described thus far involves the full utilization of all of the bins 71. It is a unique aspect of the present invention that the first bin 71A is independently controlled. This is an important feature of the present sorting apparatus, particularly if, for example, only two sets are desired. It is apparent that there could be difficulty in recycling the upper cam bank between copy sheets if only two sets are sorted.

In accordance with this invention the first two sheets are sorted as described above. The solenoid actuated gate for bin 71A is opened for the first sheet to enter the first bin and then closed. The cam bank then is indexed to open the gate for the second bin 71B to accept the second sheet into the second bin. The next sheet which is received from the processor 10 is intended for the first bin 71A.

The control system (not shown) provides a signal to the pawl actuating solenoid S1 to recycle the upper cam bank to its home position. However, the time involved to provide such recycling is greater than the time it will take for the next sheet to get to the first bin 71A. This is not a problem in the sorting apparatus of this invention since the first bin 71A is operated independently of the remaining bins 71B-I which are cam driven. Therefore, the first bin gate 90 can be returned to its open position for stripping the next sheet as the upper cam bank is being recycled to its home position.

For any desired number of sets from 1–8 or 10–15, the respective cam banks are not in their home positions after receiving the last sheet of a given page and, therefore, they must upon sensing the last sheet be recycled to their home positions by continued actuation of their respective solenoids S1 and S2 until actuation of the respective home switches 151 and 152. The lower cam bank is operated only when sorting eleven or more sets, since the deflection gate 90 for the 10th bin 71J is open when the lower cam bank is in its home position.

The drive input to the cam banks is at a relatively high speed in order to reduce the time necessary to index the cams between sheet receptions. The cams must be indexed in the time that is allowed between sheet receptions. This inter-document time is extended by means of the high speed drive imparted to the sheets 16 by the vertical transport 16 which increases the pitch or distance between incoming sheets. This allows sufficient time for the cams to index so that the deflection gate 90 for the bin receiving the next sheet to be opened as the deflection gate of the previous bin closes.

Figure 12:
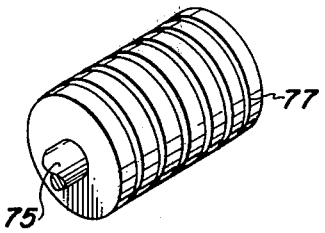
FIG. 12 is a perspective view of a ribbed type transport roller.
Figure 11:
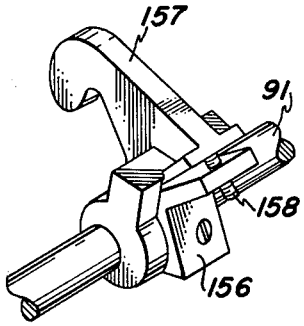
FIG. 11 is a perspective view showing an adjustable cam follower.

The follower elements 104 as in FIG. 11 comprise a first member 156 secured to the respective shaft 91 and a second member 157 pivotally supported about the shaft and connected to the first member by set screw 158. The set screw 158 can be used to adjust the operative position of the deflection gate 90. While the pinch rolls 70 are shown as comprising flat rolls they are preferably ribbed as in FIG. 12 in accordance with known practice.

Figure 9:
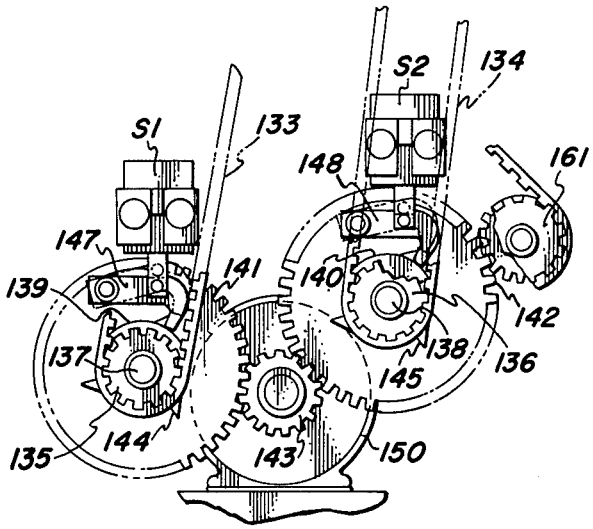
FIG. 9 is a partial rear view of the sorter motor drives system.

The drives for the vertical transport belts 61 and for the horizontal transport rolls 40 are taken off the continuously driven gear 142 by means of a gear 161 meshed therewith as shown in FIG. 9. The gear 161 is mounted to the shaft 162 which supports the drive pulleys 76 for the vertical transport belts 61 and, therefore, directly imparts the drive to those belts.

Figure 10:
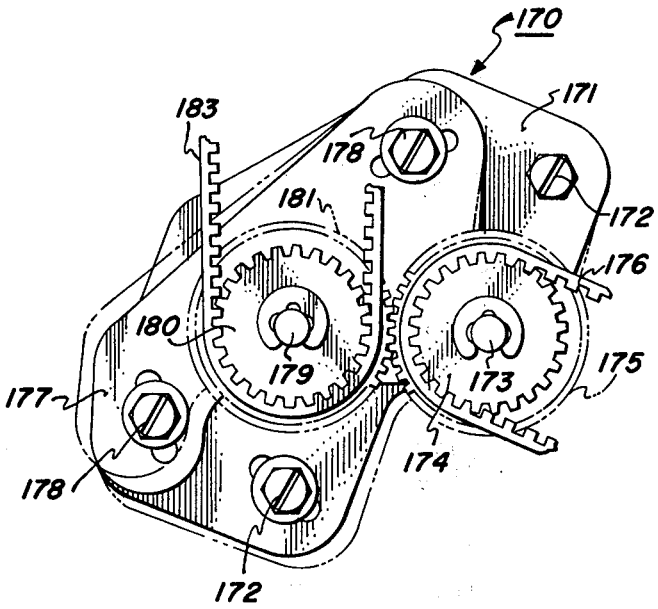
FIG. 10 is a partial rear view showing the timing belt tensioning system for the sorter transport drives.

A timing belt pulley 163 as in FIG. 3 is secured to the end of the drive shaft 162 to provide a drive connection for the horizontal transport rolls 40. A drive direction reversal timing belt tensioning system 170 as in FIGS. 3 and 10 is provided at an intermediate position. A first plate 171 is adjustably supported by the frame 50 by screws 172. A stub shaft 173 is mounted to plate 171 and corotating gear 175. A timing belt 176 is supported about pulleys 163 and 174. A second plate 177 is pivotally supported about shaft 173 and adjustably secured to plate 171 by screws 178. A stub shaft 179 is mounted to plate 177 and rotatably supports a timing belt pulley 180 and corotating gear 181 which meshes with gear 175 to reverse the drive direction. A timing belt pulley 182 is mounted via over-running clutch 64 to the lower roll drive shaft 42 of the horizontal transport rolls 40. A timing belt 183 wrapped about pulleys 180 and 182 completes the drive connection to the horizontal transport roller 40.

The belt tension of the respective belts 176 and 183 is adjusted by means of the plates 171 and 177 to which the pulleys 174 and 180 are mounted. The first belt 176 tension is adjusted by moving the inner plate 171 which is then locked in position by the screws 172. The second belt 183 tension is then set by pivoting the plate 177 and pulley 180 about the axis of the first pulley shaft 173 and then locking it in place to the inner plate 171 by means of screws 178. In this manner, the belt tensions for the timing belts 176 and 180 can be easily set without concern for the meshing engagement between the respective gears 175 and 181.

The tensions of timing belts 133 and 134 are set using adjustable idler rolls 185 and 186, respectively. The normal force between the pinch roll sets 70 is provided by cantilever springs 187 supported by the door frame 80 and urged against the ends of the shafts 75. The follower elements 104 are loaded against the cams 123 by the weight of the trays 81 acting on the levers 93. The 10th bin 71J follower element 104 is loaded against the cam 123 by a torsion spring 189.

Referring to FIGS. 1–7, and 13, it is noted that the outer bank of vertical transport pinch rollers 78 and the drive belts 61 are arranged in a door-like frame assembly 80 which can be pivoted away from the main sorter frame assembly 50 which supports the inner pinch rollers 77 and deflection gates 90. The door 80 is arranged to pivot about the input drive shaft 162, which thereby makes it unnecessary to disconnect the belt drives when the door is pivoted open. Folding links 190 are pivotally supported between the door and main sorter frame in order to prevent the door from falling completely open and for limiting the degree to which the door can be opened.

A latch mechanism 191 as in FIG. 2 is provided for holding the door 80 closed during normal operation. The latch 191 is comprised of a pivotal member 192 which includes hook portion and a lever portion. The member 192 is biased about stub shaft 193 by means of a spring 194. A catch pin 195 is arranged in the main sorter frame 50 and is engaged by the hook portion of member 192 when the door 80 is closed. To open the vertical transport door 80 the lever portion of the member 192 is merely pulled back by the operator to lift the hook away from the pin 195 and thereby allow the door to swing open. A similar latch (not shown) is provided at the opposing side.

Figure 5:
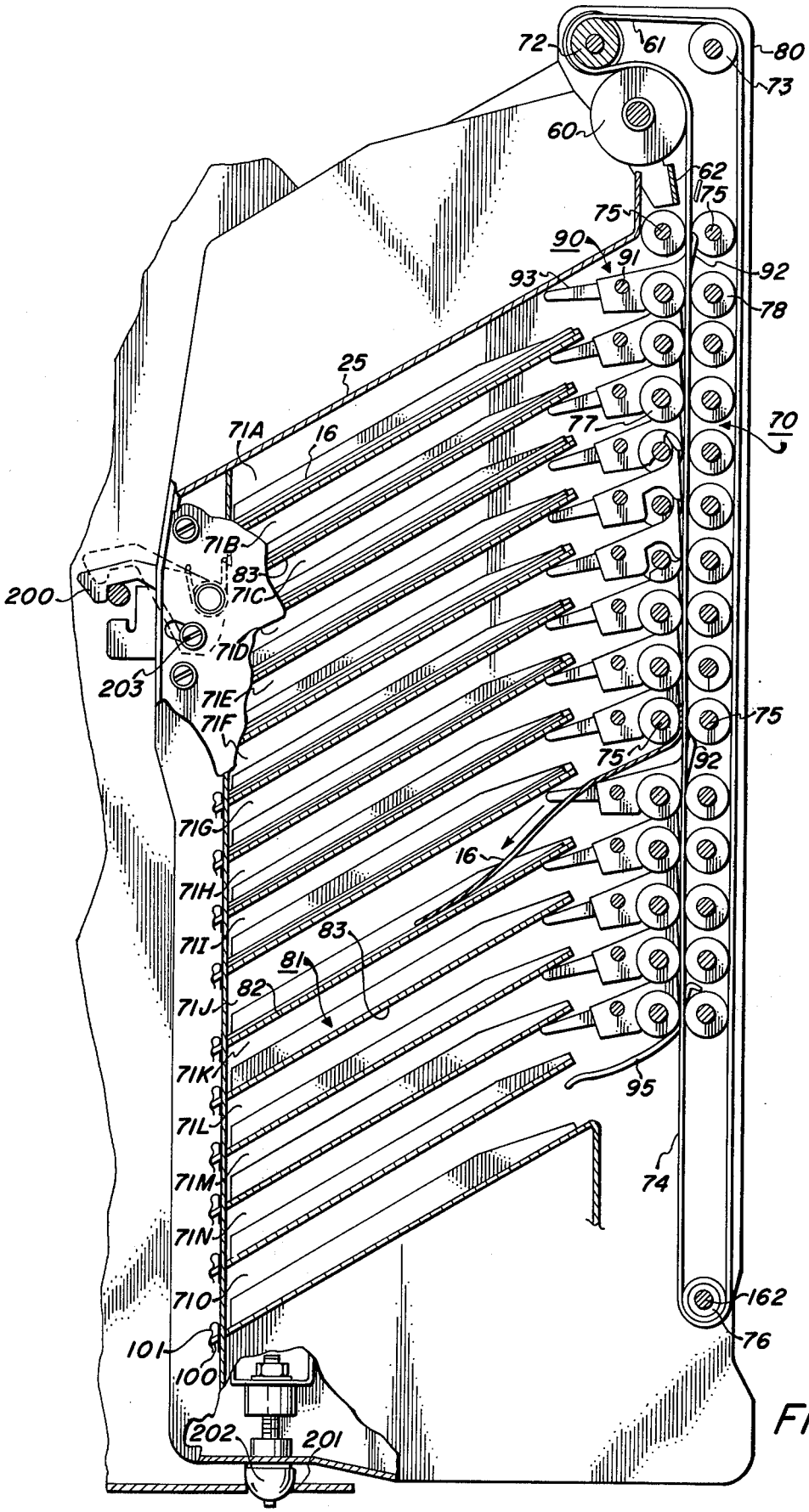
FIG. 5 is a partially cut away sectional view of the sorting apparatus.

The sorter assembly 11 is itself uniquely arranged for easy engagement and sisengagement from the reproducing machine 10. Referring, for example, to FIGS. 1 and 5, the main machine frame 198 is shown to include a bar 199 which is engageable by a hook-type latch 200 secured to the main sorter frame 50. The lower portion of the main machine frame 198 includes a circular hole 201 and a slot (not shown) arranged forwardly of the hole 201. Adjustable ball type members 202 or feet associated with the sorter frame 50 are arranged to engage the hole 201 and slot. Therefore, to attach the sorter frame 50 to the main machine frame 198, the ball type feed 202 of the sorter 11 are inserted in the circular hole 201 and elongated slot to automatically locate the sorter in proper alignment with the main machine frame. The sorter 11 is then pivoted about ball members 202 against the bar 199 and hook-type latch 200 is cammed counterclockwise by bar 199 and spring returned to latch sorter to bar 199. The latches are locked in position by means of a screw 203. A suitable electrical connector (not shown) is provided for connecting the machine controller to the sorter for providing power to the drive motor 150 and the respective solenoids 35, 111, S1 and S2, and for connecting the machine logic to the respective sensing switches 45, 151, and 152. This can be done in a conventional fashion and does not form part of the present invention.

A hook-type element 204 is supported by the sorter frame 50 and rests over the latch bar 199 of the main frame 198 so that the sorter can only be tilted away from the main machine frame a limited amount unless otherwise desired. Therefore, in accordance with this invention, not only is the vertical transport door 80 pivotal away from the main sorter frame 50, but the main sorter frame itself is arranged to be pivoted away from the main machine frame 198.

Figure 13:
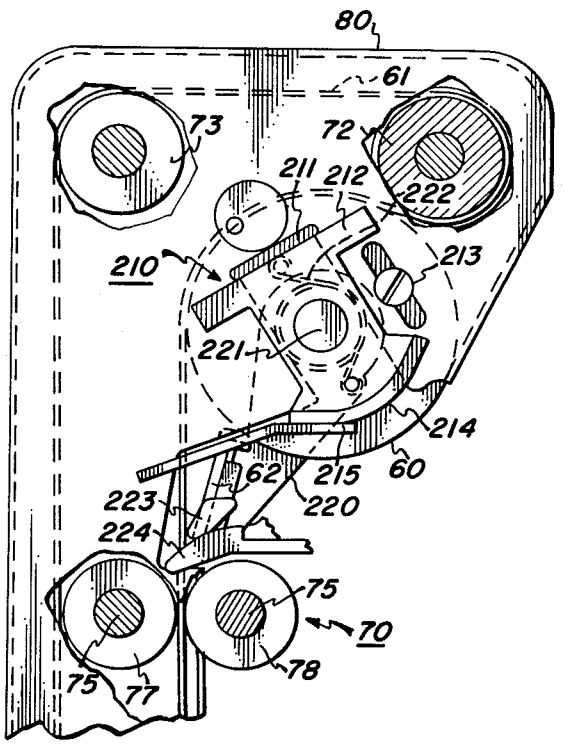
FIG. 13 is a partial front view in cross-section of a portion of the vertical transport door showing operation of the turn roll and sheet baffle camming in the sorter.
Figure 13:
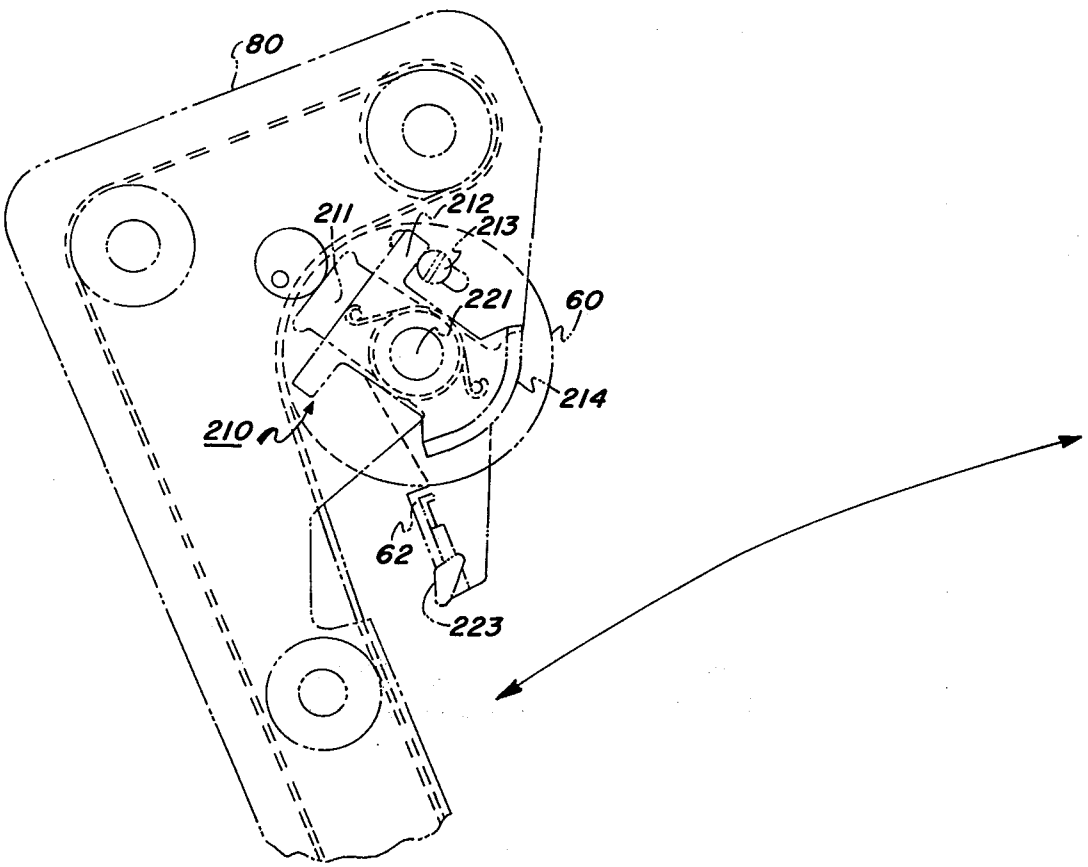

Referring now to FIG. 13, another feature of the sorting apparatus 11 of this invention is shown in greater detail. The turn roll 60 is approximately 2 inches in diameter and is employed when nipped with the feed belts 61 for transporting the sheets 16 from the horizontal transport 30 to the vertical transport 63. To provide driving engagement between the feed belts 61 and the input drive pulleys 76 the feed belts are under a substantial tension. Therefore, they engage the turn roll 60 with a substantial force. In the event of a jam wherein a sheet is left in the nip between the turn roll 60 and the feed belts 61, the high friction surface of those belts makes it extremely difficult to pull the sheet out from the nip.

In order to minimize this problem the turn roll 60 is arranged to automatically slide away from the belts 61 as the vertical transport door 80 is opened thereby reducing the nip force between it and the belts. The turn roll 60 is journaled at each end in sliding shoes 210, which in turn are supported in sliding engagement in respective slots 211 in each end of the door frame 80. The sliding shoes 210 include tabs 212 which engage adjustable stop pins 213 on the door frame 80 to limit the amount of travel of the turn roll 60 in the direction away from the belts 61. The shoes 210 also include a follower surface 214 which is arranged to engage a ramp 215 secured to the main sorter frame 50. The portion of FIG. 13 in solid lines shows the vertical transport door 80 in its operative position for sorting. The ramp 215 comprises an inclined ramp with a flattened or level portion. When the door is fully closed the follower surface 214 of the shoes 210 rests on the level portion of the ramp 215. In this position the roll 60 deflects the feed belts the maximum amount and the tension of the feed belts is set at a high value which is desired for sheet handling. When the door 80 is swung open, as shown in phantom in FIG. 13, the slide shoes 210 carry the roll 60 downwardly and outwardly of the door frame to lower the roll and to decrease the amount of deflection of the feed belts 61 thereby substantially reducing the forces between the feed belts and the roll. The travel of the feed roll 60 is limited by the aforenoted engagement of the tabs 212 on the respective slide carriages 210 with the pins 213 attached to the sorter door frame 80. By reducing the tension on the feed belts 61 by reducing their deflection through the movement of the turn roll 60 as aforenoted, it is possible to easily clear jammed sheets from between the turn roll and the feed belts.

Still referring to FIG. 13, a second feature of the turn roll assembly is shown which comprises a sheet guide baffle 62. This guide baffle 62 is arranged to insure that a sheet 16 as it exits the nip between the turn roll 60 and the feed belts 61 is properly fed into the nip between the first set of pinch rollers 70. In solid lines the baffle 62 is shown in its operative position wherein it defines at its upstream end a relatively wide gap between it and the belts 61 for intercepting a sheet coming out of the turn roll nip, and at its downstream end a relatively narrow gap for guiding a sheet into the nip of the first set of pinch rolls 70. The narrow gap makes it difficult to clear a sheet jammed between the turn roll 60 and the feed belts 61 if one is pulling from below the turn roll.

Therefore, in accordance with the preferred feature of this invention, the guide baffle 62 is supported by pivot arms 220 at each end thereof which in turn are arranged to pivot about the shaft 221 of the turn roll. A torsion spring 222 is arranged with one end pinned to the slide shoe 210 and the other end pinned to an arm 220 of the pivoting baffle 62 so as to urge the baffle to a normally opened position as shown in phantom. In the open position of the baffle 62 the gap between it and the belts 61 is widened to allow easy jam clearance. Closure of the baffle 62 or its pivotaly movement to its operative position as shown in solid lines is accomplished by means of a follower tab 223 attached to it which in turn engages a cam-like member 224 which is secured to the main sorter frame 50. As the door is closed, the follower tab 223 of the pivoting baffle 62 engages the stationary cam 224 and is caused to pivot to its operative position as shown in solid lines. The engaging surfaces of the tab 223 and cam 224 are shaped as shown to provide a progressive camming action which as the roll 60 rises results in a generally sinusoidal motion of the baffle 62 required to clear the first pin 71A deflection gage 90. The tab 223 operative surface comprises an inclined plane with a curved tip. The cam 224 operative surface is curved convexly.

Figure 7:
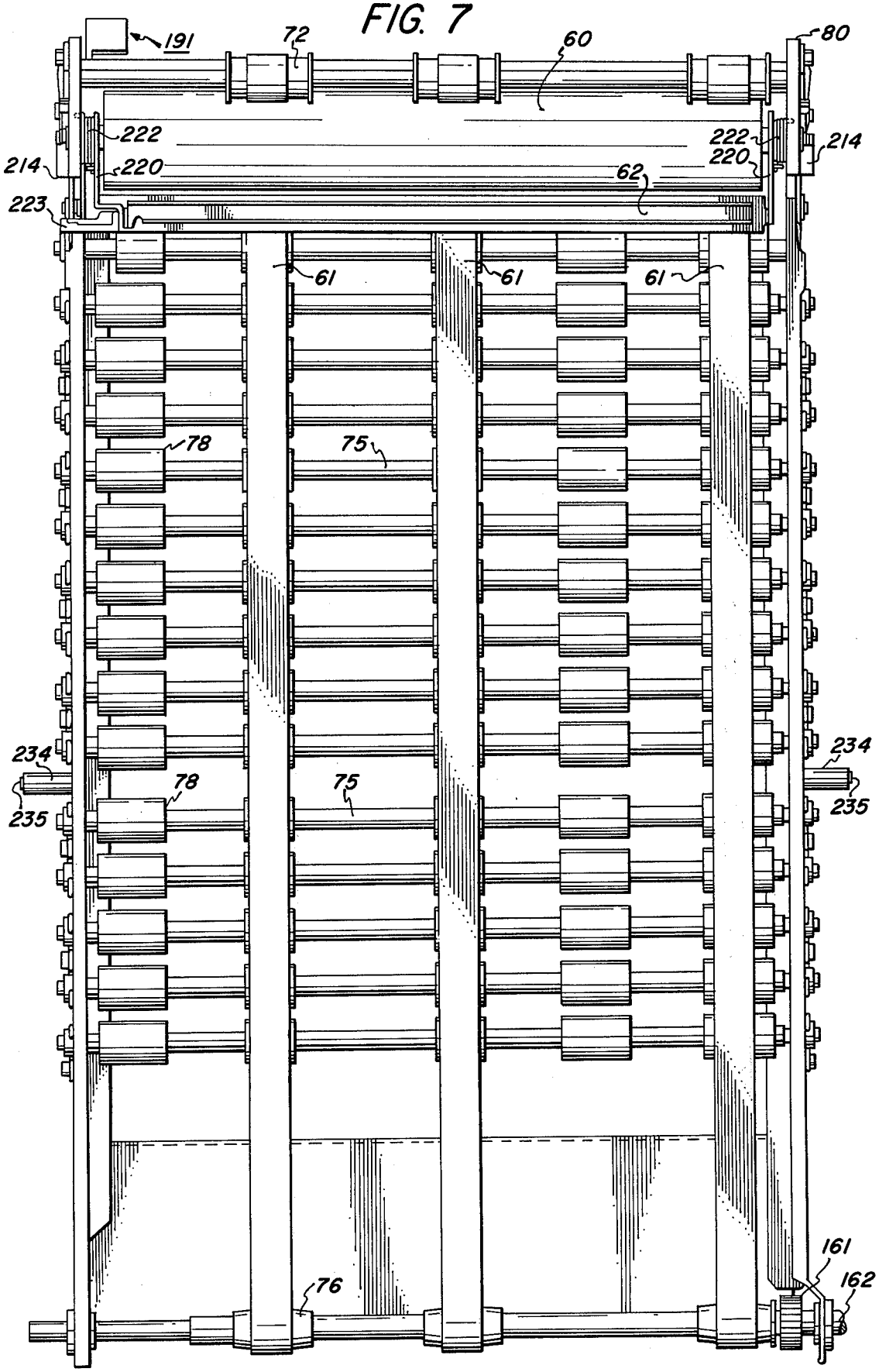
FIG. 7 is an inside view of the vertical transport door of the sorter apparatus.
Figure 14:
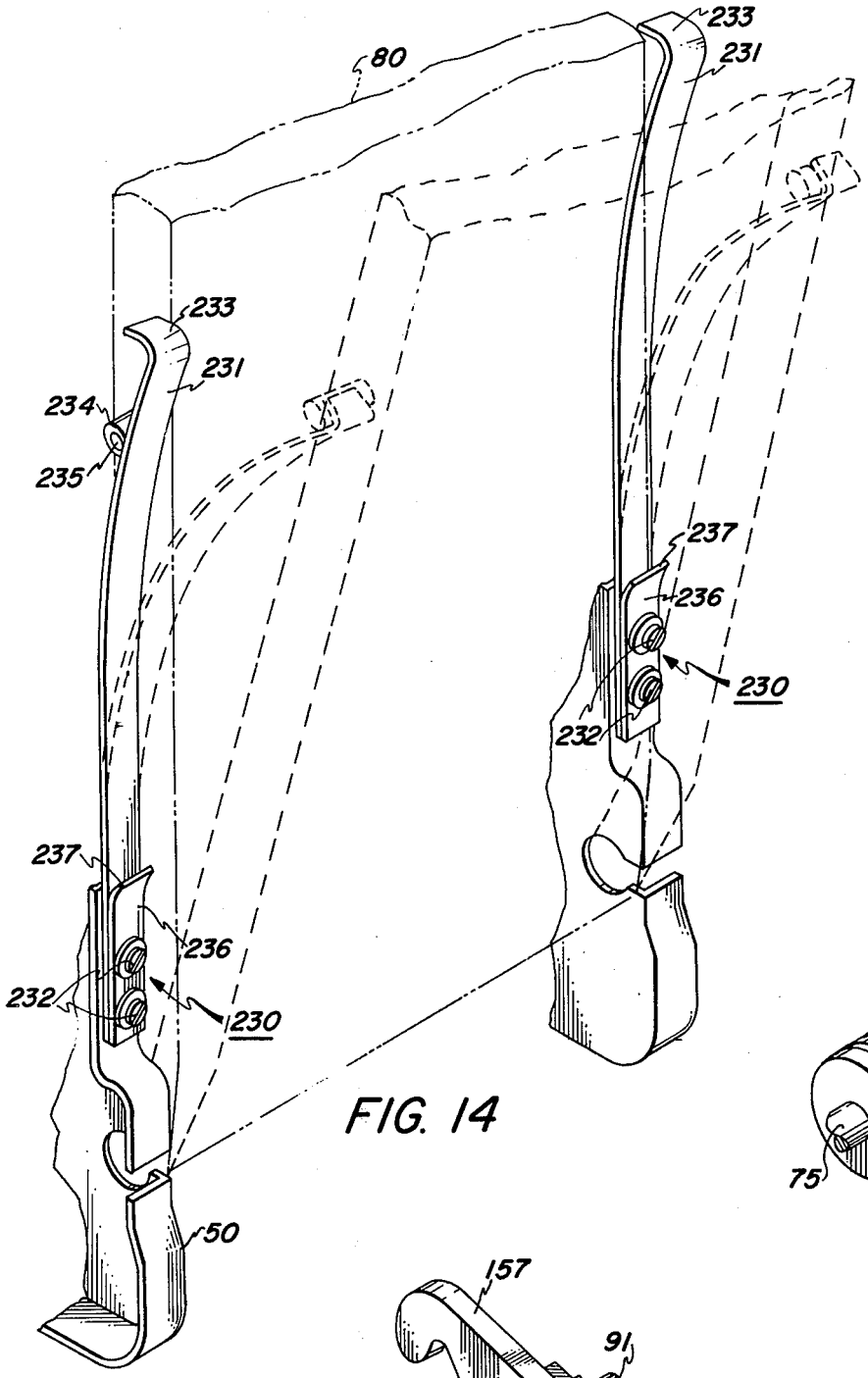
FIG. 14 is a partial perspective view of the sorting apparatus showing operation of the vertical transport door counterbalance.

Referring now to FIGS. 3, 7 and 14, the counterbalance mechanism 230 used to counterbalance the vertical transport door 80 when it is pivoted away from the main sorter frame 50 is shown. The counterbalance mechanism comprises two leaf springs 231 mounted in cantilever fashion to the main sorter frame 50 by screws 232. The free end of each leaf spring includes a curved lip 233. The door 80 itself includes a roller 234 at each end which is preferably formed of nylon or a similar material. The rollers 234 are supported for rotation about stub shafts 235 mounted to the door frame 80. These rollers 234 engage the leaf springs 231 so that as the door is opened the rollers ride along the springs toward the lips 233. The leaf springs 231 are secured to the main sorter frame 50 by means of plate members 236. The plate members 236 include a flared portion. The plate members 236 control the deflection of the springs 231 as they are counterbalancing the door to prevent over-stressing the springs.

The action of the rolls 234 against the leaf springs 231 allows the leaf springs to counterbalance the door 80. As the door 80 is opened the springs 231 are deflected as the roll rides along the spring surface. In this manner effective counterbalancing of the door 80 is provided which prevents sudden shocks to the machine 10 as the sorter door 50 is opened.

Figure 15:
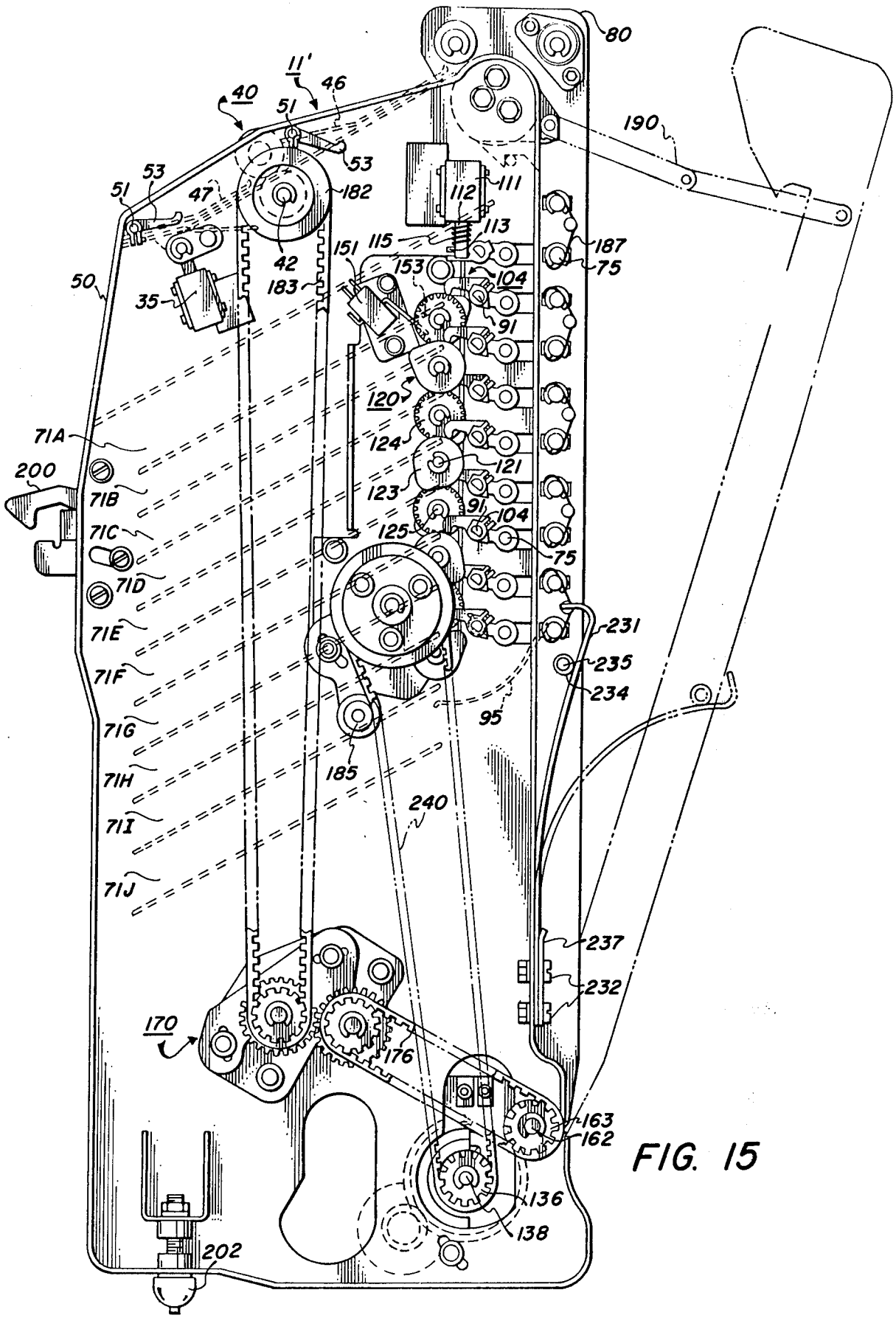
FIG. 15 is a rear view of a sorting apparatus in accordance with a different embodiment of this invention having ten bins.

Referring now to FIGS. 5 and 15, a ten bin version of the sorting apparatus 11' of the present invention is shown in detail. As indicated previously, the sorting apparatus of this invention is of a modular construction and can be provided with any desired number of bins 71 and in particular it can be provided so that it can have one number of bins or alternatively a somewhat larger number of bins. This is accomplished in a single vertical array. If ten bins are used they are aligned vertically, and if fifteen bins are used they are also aligned vertically.

In order to accomplish this modularity the tenth intermediate bin 71J is arranged to be a full width bin as aforenoted. The deflection gates 90 for the tenth bin 71J and through the 15th bin 71N of the 15 bin sorter are driven by means of the lower cam bank, as shown in FIGS. 3 and 8. If only a ten bin sorter is desired, the lower cam bank, deflection gates 90 for bins 71J to 71N, the drive gear 141, the wrap spring clutch 139, the solenoid S1 and pawl 147 can all be eliminated.

The drive for pulley 125 is taken from the drive pulley 136 previously used to power the lower cam bank. A timing belt 240 is wrapped about pulleys 125 and 136. The control signals previously applied to solenoid S1 in the fifteen bin version 11 are applied to the solenoid S2 in the ten bin version 11'.

In the ten bin version 11' there is no need for this deflection gate 90 for the 10th bin 71J, since the deflection chute 95 of the 15th bin 71O is moved up to the 10th bin position. Therefore, in converting to 10 bins from 15 bins there is no necessity to change the upper cam bank for driving the deflection gates, since they are driven in the same manner as in 15 bin version 11 described above. Therefore, the sorting apparatus of this invention is uniquely modularly constructed so that the number of bins in the sorting array can be selectively changed as desired without over complicating the drive system. A high degree of commonality is achieved between ten bin configuration 11' and the fifteen bin configuration 11. The other elements of the ten bin configuration 11' are the same as described by reference to the fifteen bin configuration 11.

The sorter control system does not form a part of the present invention. Any desired control system could be used. For example, any of the various control systems noted in the prior patents referenced herein could be adapted to provide the desired control and sequencing signals necessary to operate the sorters 11 or 11'. It is only necessary to feed the first bin operable signal to solenoid 111 and the remaining bin operable signals to solenoids S1 and S2, respectively, to provide the desired sequencing.

Therefore, in accordance with the present invention, a sorting apparatus is provided comprising a vertical array of bins wherein generally horizontally extending trays are supported in a vertical alignment. In order to achieve compactness of the system a number of the bins are spaced closely together and bin entrance opening means are provided for expanding the opening of those bins as a sheet is to be fed into them. Certain of the bins, however, are spaced wider than the compact bins. This combination of full width and reduced width bins provides a more compact arrangement than would be obtained by a full width bin array alone while at the same time offering flexibility and reduced cost in modularizing the sorter.

A further unique aspect of the sorting apparatus of this invention comprises a drive system wherein the first bin in the sorting array is driven independently of the remaining bins of the array, and wherein the remaining bins of the array are driven by a sequential cam drive system.

In accordance with this invention this unique combination of solenoid and cam drives eliminates throughput reductions associated with sorting low numbers of sets. This is particularly important when the copier includes a document handling system 250 as in FIG. 1, which is arranged to place documents on and off the viewing platen. With such a system it is possible to maintain the full throughput of the copier even with document change. Using the sorting apparatus 11 or 11' of this invention, it is not necessary to delay the copying cycle after document change because of the necessity to recycle the sorter cam banks to their home positions.

The patents and texts referred to specifically in detailed description of this application are intended to be incorporated by reference into the description.

It is apparent that there has been provided in accordance with this invention a sorting apparatus and reproducing machine which fully satisfies the objects, means and advantages set forth hereinbefore. While the invention has been described in conjunction with specific embodiments therefor, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a sorting apparatus for collating the output of a reproducing machine, said apparatus comprising:

a plurality of sheet receiving bins;

a first frame for supporting said sheet receiving bins;

sheet transport means for transporting said sheets to said bins including at least one transport member and at least one belt under a desired tension, said transport member and said belt being arranged to form a nip therebetween to transport sheets therethrough;

a second frame for supporting said sheet transport means; and means for supporting said frames for relative movement between a first closed position wherein said sheet transport means is operatively associated with said bins, and a second open position wherein access is provided to said sheet transport means and said bins for sheet clearance therefrom; the improvement wherein:

means are provided for reducing said desired belt tension responsive to the relative movement of said frames from said first closed position to said second open position;

whereby clearance of said sheets from said sheet transport means is facilitated by the reduction in the tension of said at least one belt.

2. An apparatus as in claim 1, wherein said belt and said transport member are arranged so that a force is provided between said belt and said member at said nip which is a function of said belt tension, whereby reduction of said belt tension from said desired belt tension in response to the relative movement of said frames also reduces the force between said belt and said member at said nip thereby facilitating the removal of sheets from said nip.

3. An apparatus as in claim 2, wherein said transport member comprises a roll and wherein said at least one belt comprises a plurality of spaced apart belts each arranged to form said nip with said roll.

4. An apparatus as in claim 3, wherein said second frame is pivotally supported by said first frame for movement between said first and second positions.

5. An apparatus as in claim 4, wherein said tension reducing means comprises means for supporting said roll for movement in said second frame between a first position wherein said roll deflects said belts a given amount to provide said desired belt tension and a second position in a direction away from said belts to reduce said deflection of said belts and thereby reduce said belt tension below said desired belt tension.

6. An apparatus as in claim 5, wherein said roll is arranged for sliding movement within said second frame, whereby said roll slides between its respective first and second positions.

7. An apparatus as in claim 6, further including cam means supported by said first frame and follower means connected to said roll, said follower means being arranged to engage said cam means upon the closing of said first and second frames, whereby the action of said cam means against said follower means causes said roll to move from said second position to said first position to provide said desired belt tension.

8. An apparatus as in claim 7, wherein said cam means includes an inclined portion for gradually moving said roll between said second position and said first position as said first and second frames are closed.

9. An apparatus as in claim 8 further including:

means for counterbalancing said second frame as it is moved from said first closed position to said second open position, said counterbalancing means comprising at least one leaf spring mounted in cantilever fashion.

10. In a sorting apparatus for collating the output of a reproducing machine, said apparatus comprising:

a plurality of sheet receiving bins;

a first frame for supporting said sheet receiving bins;

sheet transport means for transporting said sheets to said bins;

a second frame for supporting said sheet transport means and means for supporting said second frame for movement between a first closed position wherein said sheet transport means is operatively associated with said bins and a second open position to provide access to said sheet transport means and said bins for sheet clearance therefrom; the improvement wherein:

means are provided for counterbalancing said second frame as it is moved from said first position to said second position, said counterbalancing means comprising at least one leaf spring mounted in cantilever fashion on said first frame and said second frame including at least one rotatably supported member for engaging said leaf spring.

11. An apparatus as in claim 10, wherein said second frame is pivotally supported by said first frame for movement between said first and second positions.

12. An apparatus as in claim 11, including a plurality of said leaf springs and a corresponding plurality of members for engaging said springs.

13. An apparatus as in claim 12, wherein said members for engaging said cantilever springs comprise rollers rotatably supported by said second frame.

14. An apparatus as in claim 13, wherein said springs have a convexly curved surface for engagement by said rollers.

15. In a sorting apparatus for collating the output of a reproducing machine, said apparatus comprising:

a plurality of sheet receiving bins;

a first frame for supporting said sheet receiving bins;

sheet transport means for transporting said sheets to said bins including at least one transport member and at least one belt under a desired tension, said transport member and said belt being arranged to form a nip therebetween to transport sheets therethrough;

a second frame for supporting said sheet transport means; and means for supporting said frames for relative movement between a first closed position wherein said sheet transport means is operatively associated with said bins, and a second open position wherein access is provided to said sheet transport means and said bins for sheet clearance therefrom; the improvement wherein:

means are provided for reducing said desired belt tension responsive to the relevant movement of said frames from said first closed position to said second open position, said tension reducing means comprising means for supporting said at least one transport member for movement in said second frame between a first position wherein said member deflects said belt a given amount to provide said desired belt tension and a second position in a direction away from said belt to reduce said deflection of said belt and thereby reduce said belt tension below said desired belt tension;

whereby clearance of said sheets from said sheet transport means is facilitated by the reduction in the tension of said at least one belt.

* * * * *